US007730588B1

(12) United States Patent
Bernier

(10) Patent No.: US 7,730,588 B1
(45) Date of Patent: Jun. 8, 2010

(54) FIRE HOSE HOLDING APPARATUS

(76) Inventor: Claude Bernier, 106 Gotham Ave., Elmont, NY (US) 11003

( * ) Notice: Subject to any disclaimer, the term of this patent is extended or adjusted under 35 U.S.C. 154(b) by 0 days.

(21) Appl. No.: 12/270,536

(22) Filed: Nov. 13, 2008

(51) Int. Cl.
*B25G 3/32* (2006.01)

(52) U.S. Cl. ..... 16/422; 24/271; 248/76; 294/15

(58) Field of Classification Search ..... 16/422, 16/426, 110.1; 248/76, 231.31, 316.2; 24/271, 24/280; 285/411, 419, 420; 269/254 CS; 294/148, 166, 15; 251/7
See application file for complete search history.

(56) References Cited

U.S. PATENT DOCUMENTS 2,018,906 A 10/1935 Winter
2,775,806 A 1/1957 Love
4,467,997 A * 8/1984 Ziaylek, Jr. ..... 251/7
4,470,177 A 9/1984 Ganung et al.
4,655,492 A 4/1987 Landry
4,856,834 A 8/1989 Lancaster et al.
4,978,100 A * 12/1990 Peurifoy ..... 251/8
5,136,757 A 8/1992 Labonville
5,311,909 A * 5/1994 Adcock ..... 137/899
D360,128 S 7/1995 Huffine
5,979,840 A * 11/1999 Hollister et al. ..... 248/76

* cited by examiner

*Primary Examiner*—William L. Miller
(74) *Attorney, Agent, or Firm*—Kyle Fletcher

(57) ABSTRACT

The invention is a fire hose holding apparatus that involves a hose clamp that involves two halves that are connected together via a hinge and a handle. Located along the interior of said two halves are rubber strips. The locking apparatus involves a locking clip on the opposite ends of the two halves and locking notch in the handle.

8 Claims, 5 Drawing Sheets

FIRE HOSE HOLDING APPARATUS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of fire hose clamping devices for use by firemen when fighting a fire.

B. Discussion of the Prior Art

As a preliminary note, it should be stated that there is an ample amount of prior art that deals with fire hose holding apparatuses. As will be discussed below, no piece of prior art discloses a fire hose holding apparatus that has in addition to a handle, a squeezing clamp that enables the apparatus to be moved along the fire hose without disengaging the apparatus from the fire hose.

The Ganung et al. (U.S. Pat. No. 4,470,177) discloses a fire hose clamp provided with a hand grip for firemen for use on a fire hose when fighting a fire to resist the back pressure acting on the hose. The device has a rubber insert to prevent it from slipping on the hose. However, the rubber insert is not spring-loaded in order to place a clamping force on the hose when in use, and of which can be removed to slide the apparatus along the fire hose.

The Lancaster (U.S. Pat. No. 4,856,834) discloses a quick release clamp to easily receive, slide upon, and secure a fire hose with any moving parts. However, the no-moving parts clamp relies on an open end of said clamp to enable the hose to enter and exit as opposed to a holding apparatus that uses a rubber clamp that is spring-loaded along with a locking clasp to secure the apparatus about the fire hose.

The Labonville (U.S. Pat. No. 5,136,757) discloses a fire hose clamp that has two flexible straps permanently connected at their upper ends by a pivotal lever and detachably connected at their lower ends by means of a pawl and ratchet assembly. However, the fire hose clamp uses a pawl and ratchet assembly as opposed to a locking clasp. Also, the fire hose clamp does not have a handle but a strap to be worn about a firefighter's neck.

The Landry (U.S. Pat. No. 4,655,492) discloses an improved hose gripping tool for use with high pressure hoses, such as fire hoses. However, the hose gripping tool involves no moving parts and is not secured upon a hose by a locking clasp or a spring-loaded rubber insert as a means of securing the fire hose in place with respect to the holding apparatus.

The Love (U.S. Pat. No. 2,775,806) discloses an adjustable girth clamping ring. The girth clamping ring does not include a handle, and also does not secure itself about a tubular object by a locking clasp. In addition, the clamping ring docs not include a rubber insert that has a biasing force placed upon the fire hose by a single or plurality of springs, which secures the fire hose in place with respect to the holding apparatus.

The Winter (U.S. Pat. No. 2,018,906) discloses a hose clamp that can be locked in place upon said hose. Again, the hose clamp does not include a handle, and also does not secure itself about a tubular object by a locking apparatus that involves a spring-loaded rubber insert with a locking clasp.

The Huffine (U.S. Pat. No. Des. 360,128) illustrates a design for a fire hose gripping tool, which does not illustrate a locking clasp nor a spring-loaded rubber insert.

While the above-described devices fulfill their respective and particular objects and requirements, they do not describe a fire hose holding apparatus that has a handle, locking clasp, and spring-loaded rubber insert that enables the apparatus to slide along the fire hose by pulling back the springs located between the apparatus and the rubber insert. Some of the prior art used a separate locking apparatus or a no-moving part assembly. In this regard, the fire hose holding apparatus departs from the conventional concepts and designs of the prior art.

SUMMARY OF THE INVENTION

The invention is a fire hose holding apparatus that involves a hose clamp that involves two halves that are connected together via a hinge. A handle is permanently affixed to an outer surface of one of the two halves. Located along the interior of said two halves is a rubber insert that has a biasing force pushing the rubber insert towards the center of the apparatus. The two halves are secured closed via a locking clasp. The biasing force upon the rubber insert can be removed via a release handle, which enables a fire hose to slide with respect to the apparatus.

It is an object of the invention to provide a fire hose holding apparatus wherein the apparatus can slide back and forth with respect to a fire hose when in use via the rubber insert.

A further object of the invention is to provide a fire hose holding apparatus that can lock itself upon a fire hose via a locking clasp.

A further object of the invention is to provide a fire hose holding apparatus wherein the interior of the clamp has a rubber insert or material having a high coefficient of friction.

A further object of the invention is to provide a fire hose holding apparatus that is lightweight, easy to install and remove, affordable, and effective.

These together with additional objects, features and advantages of the fire hose holding apparatus will be readily apparent to those of ordinary skill in the art upon reading the following detailed description of presently preferred, but nonetheless illustrative, embodiments of the fire hose holding apparatus when taken in conjunction with the accompanying drawings.

In this respect, before explaining the current embodiments of the fire hose holding apparatus in detail, it is to be understood that the fire hose holding apparatus is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the fire hose holding apparatus.

It is therefore important that the claims be regarded as including such equivalent construction insofar as they do not depart from the spirit and scope of the fire hose holding apparatus. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
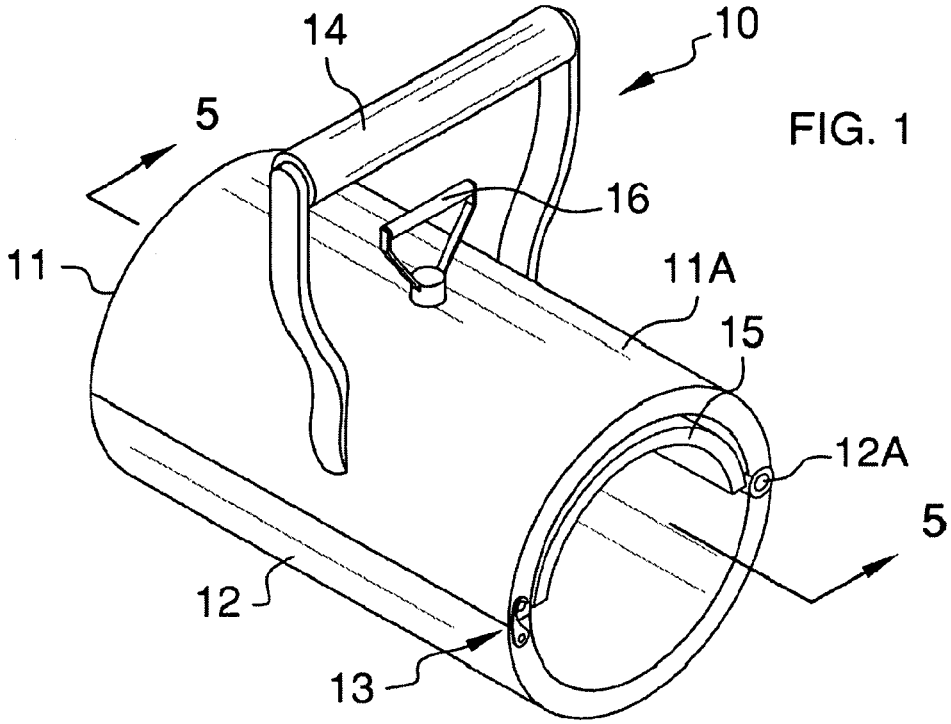
FIG. 1 illustrates a top, isometric view of the invention with the hose clamp in the closed position.
Figure 2:
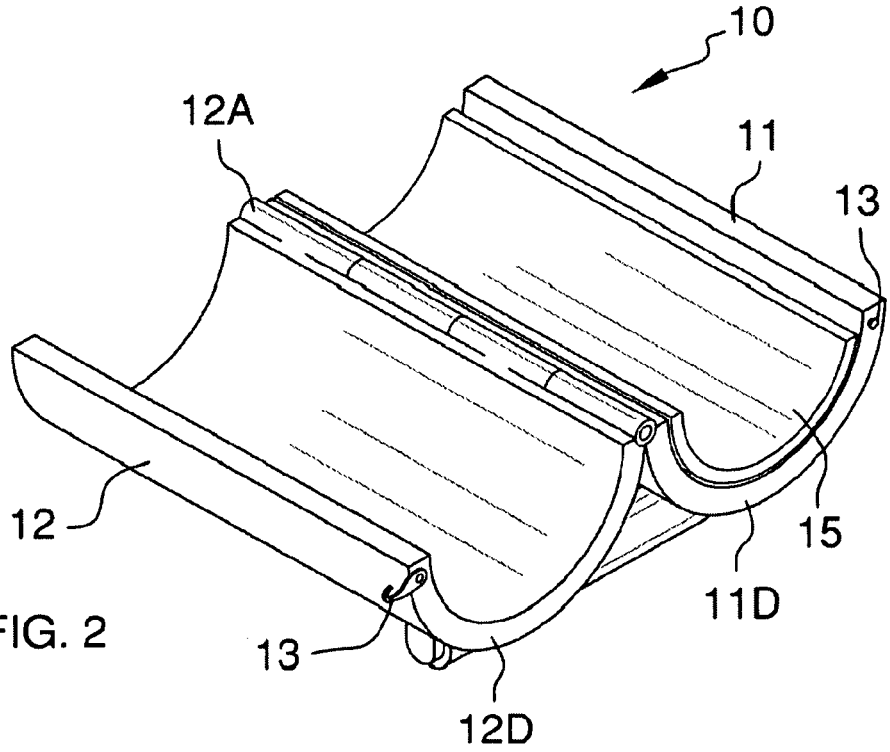
FIG. 2 illustrates a top, isometric view of the hose clamp in an open position.
Figure 3:
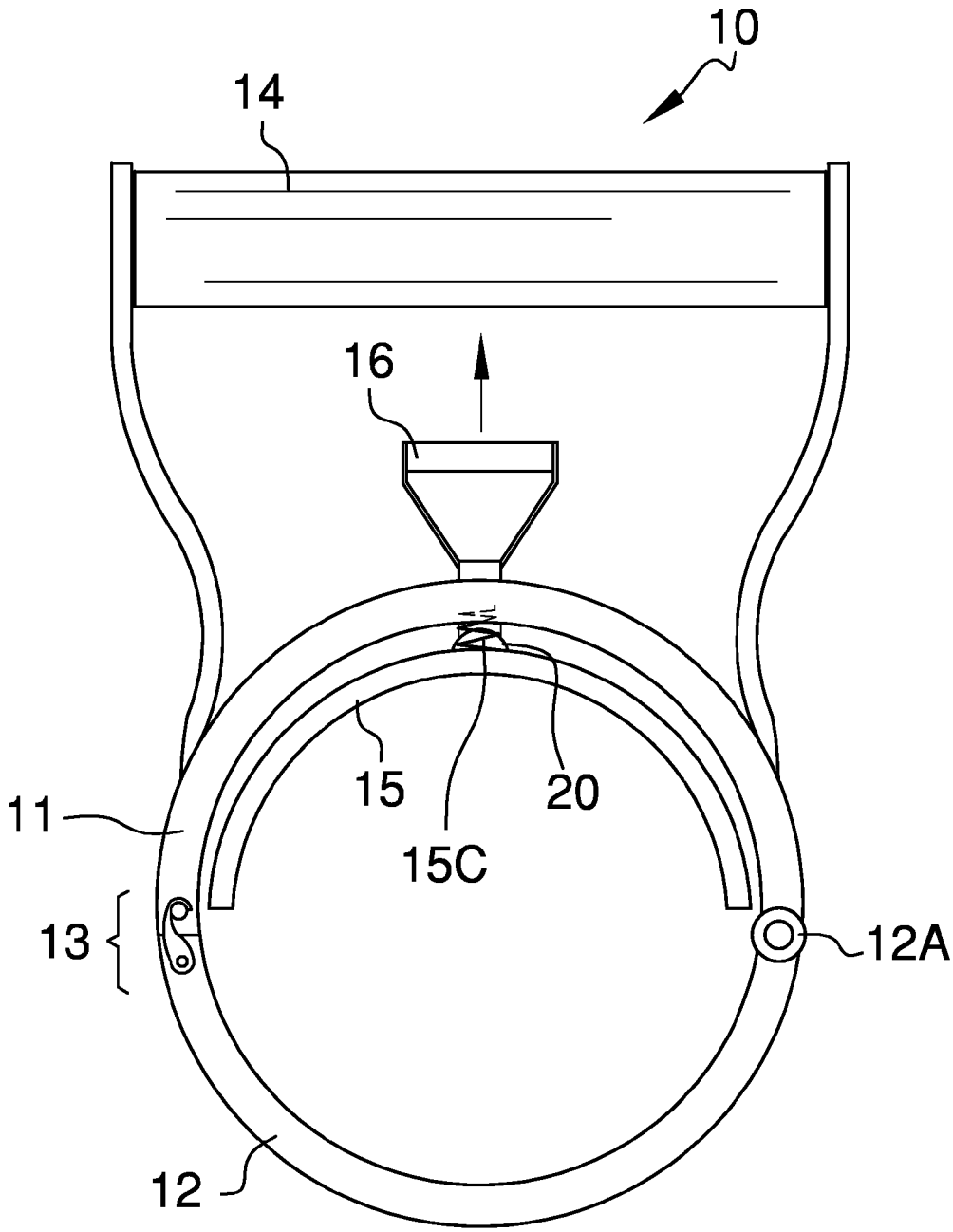
FIG. 3 illustrates a front view of the invention.
Figure 4:
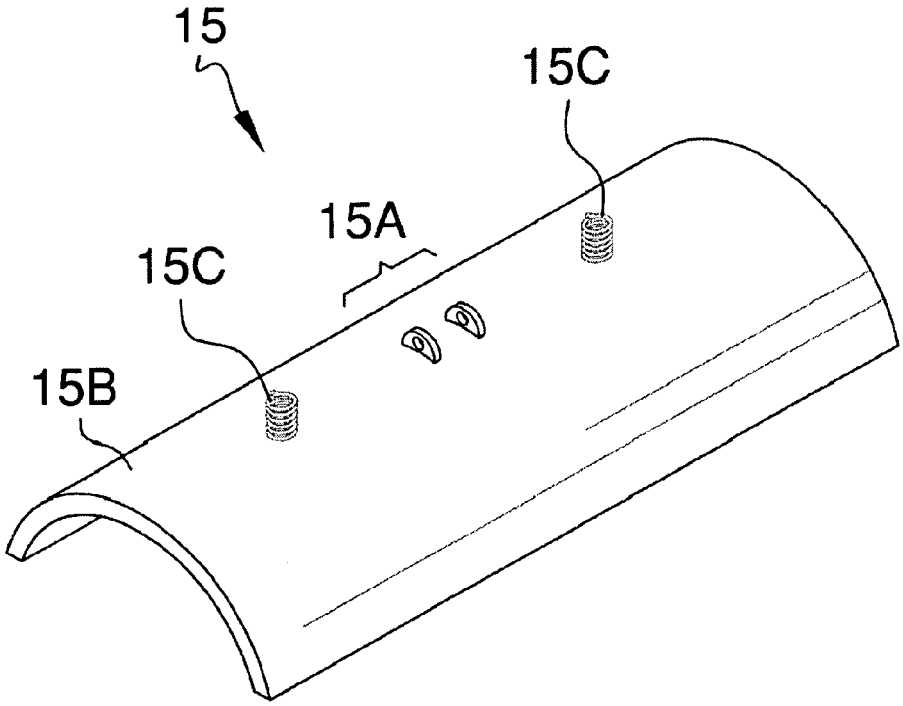
FIG. 4 illustrates an isometric view of the rubber insert.
Figure 5:
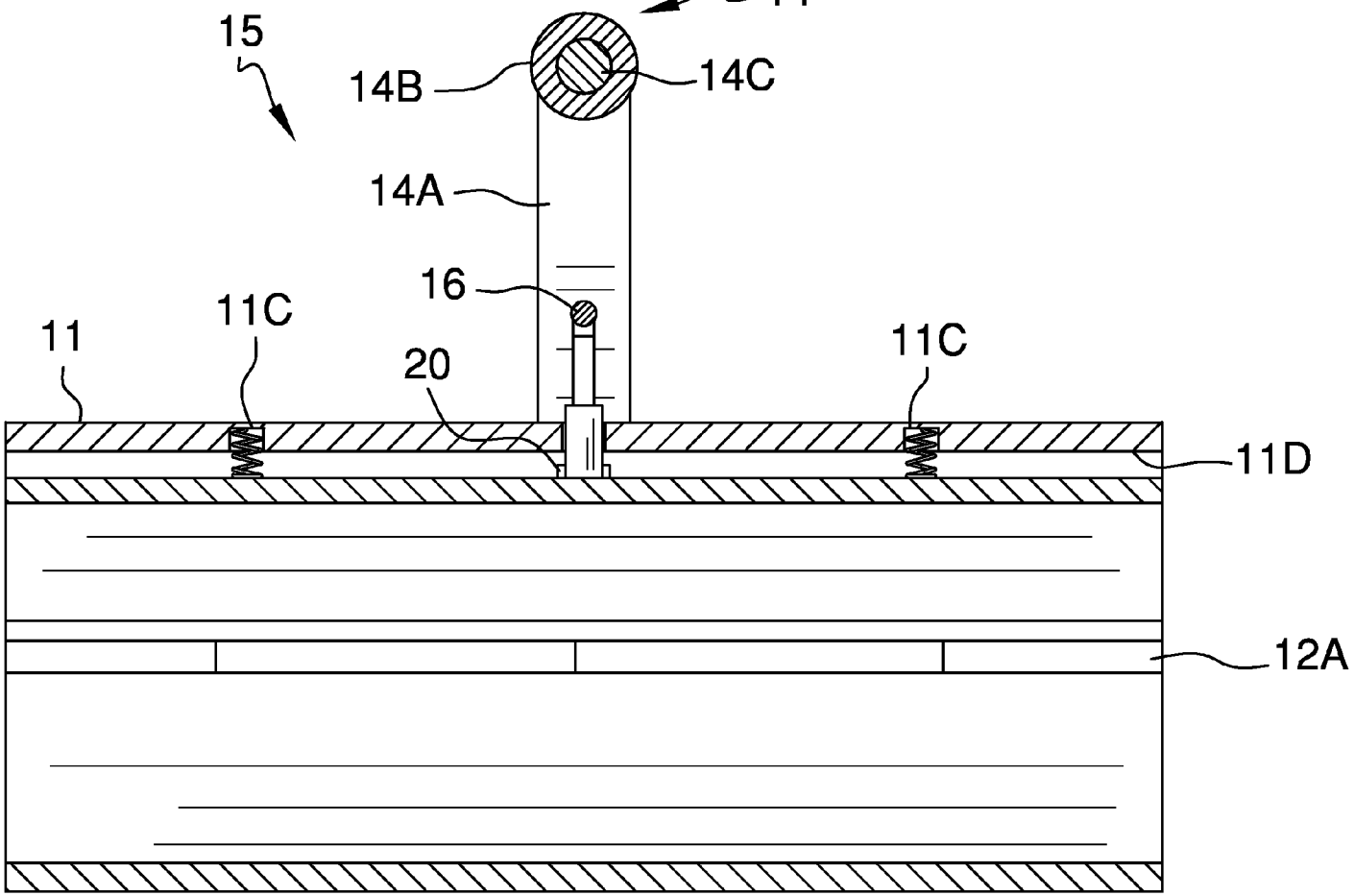
FIG. 5 illustrates a cross-sectional view of the invention along line 5-5 in FIG. 1.
Figure 6:
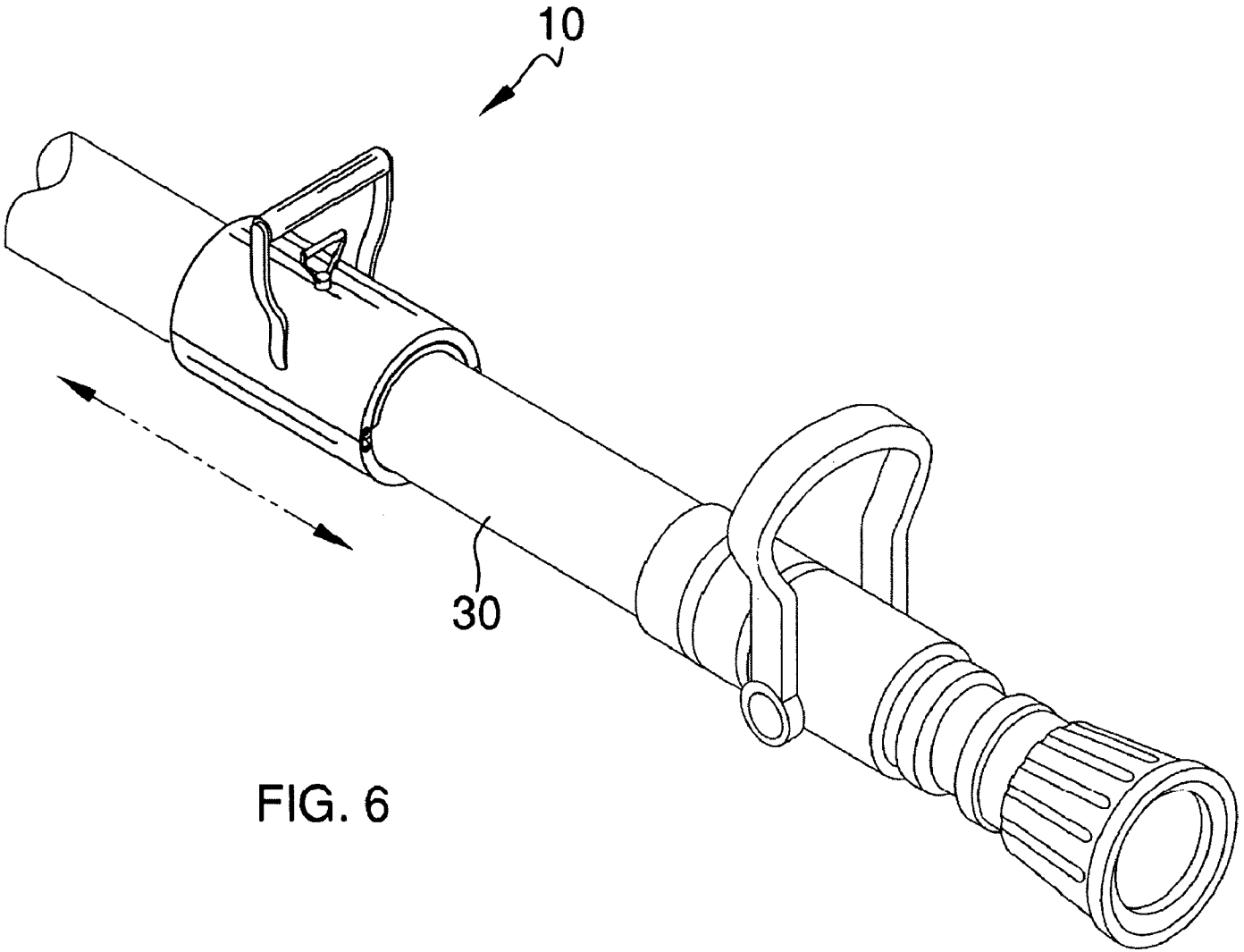
FIG. 6 illustrates the invention in use on a fire hose with lines indicating movement along the fire hose.

Detailed reference will now be made to the preferred embodiment of the present invention, examples of which are illustrated in FIGS. 1-6. A fire hose holding apparatus 10 (hereinafter invention) includes a top half 11, a bottom half 12, a locking clasp 13, a handle 14, a rubber insert 15, and a release handle 16.

The top half 11 is connected to the bottom half 12 via a hinge 12A. The top half 11 and the bottom half 12 may be considered, collectively, a clamp. The top half 11 has the handle 14 mounted at an outer surface 11A of the top half 11. The top half 11 also has a release handle hole 11B, which enables the release handle 16 to pass there through.

The rubber insert 15 has a release handle connectors 15A located on an outer surface 15B of the rubber insert 15. The rubber insert 15 also has a plurality of springs 15C mounted along the outer surface 15B. The top half 11 has a plurality of recesses 11C located on an inner surface 11D of the top half 11.

It shall be important to note that the location of the handle 14, rubber insert 15, recesses 11C may be located on the bottom half 12 as opposed to the top half 11.

The release handle 16 is installed upon placing a first end 16A of the release handle 16 through the release handle hole 11B of the top half 11. Next, the release handle connectors 15A are connected to the first end 16A of the release handle 16 by a connecting means 20. The connecting means comprises a rivet, a bolt, a screw, cotter pin, or an insert. The plurality of springs 15C impose a biasing force upon the rubber insert 15, which forces the rubber insert 15 towards the center of the top half 11 and bottom half 12 when closed.

The too half 11 and the bottom half 12 secure together via the locking clasp 13, which adorn a second surface 11D and 12D of the top half 11 and bottom half 12, respectively. Alternatively, a second locking clasp 13 may be included on a surface opposite the second surfaces 11D and 12D.

The handle 14 is made of a frame 14A, which actually connects to the outer surface 11A of the top half 11; and a spinning handle 14B, which can rotate about a handle center 14C. The frame 14A, spinning handle 14B, and handle center 14C are made of a material of sound construction such as wood, metal, a durable plastic, or a carbon fiber. The top half 11, the bottom half 12, the hinge 12A, the locking clasp 13, and the release handle 16 are made of a material comprising wood, metal, durable plastic, or a carbon fiber.

The invention 10 is used by placing a fire hose 30 between the top half 11 and the bottom half 12, and then securing the bottom half 12 to the top half 11 by the locking clasp 13. The location of the invention 10 with respect to the fire hose 30 may be adjusted via lifting the release handle 16, which in turn removes the biasing force on the rubber insert 15 via the springs 15C. Alternatively, the invention 10 may also be rotated about the fire hose 30 via lifting the release handle 16 and rotating the top half 11 and bottom half 12 about the fire hose 30. It is being asserted that a primary benefit of the invention 10 is the inclusion of the rubber insert 15 and release handle 16.

The rubber insert 15 may be made from a material other than rubber, comprising a material that has a high coefficient of friction, which is desired when interacting with the fire hose 30.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A fire hose holding apparatus comprising:

(a) a clamp;

wherein the clamp is composed of a top half and a bottom half that are connected via a hinge;

wherein a fire hose may be placed between the top half and the bottom half;

wherein a locking clasp secures the top half to the bottom half on a side opposite the hinge;

wherein upon closing the top half onto the bottom half in order to form an interior circle;

(b) a handle;

wherein the handle is attached to the top half;

(c) a rubber insert;

wherein the rubber insert is biased away from an inner surface of the top half via at least one spring;

wherein the rubber insert secures the fire hose with respect to the clamp;

(d) a release handle;

wherein the release handle secures to the rubber insert via a connecting means;

wherein pulling upon the release handle in an upward direction generally transverse to a longitudinal axis of the portion of the fire hose within the clamp compresses the spring, and thus un-secures the fire hose within the clamp, thus enabling lateral or rotational movement of the clamp about the fire hose.

2. The fire hose holding apparatus as described in claim 1 wherein a plurality of springs bias the rubber insert away from the inner surface of the top half.

3. The fire hose holding apparatus as described in claim 2 wherein the connecting means comprises a rivet, a bolt, a screw, cotter pin, or an insert.

4. The fire hose holding apparatus as described in claim 1 wherein the top half, bottom half, the hinge, the handle, the locking clasp, and the release handle are made of a material comprising wood, metal, durable plastic, or a carbon fiber.

5. The fire hose holding apparatus as described in claim 1 wherein the rubber insert is made of a material other than rubber, which has a high coefficient of friction.

6. The fire hose holding apparatus as described in claim 1 wherein the handle further consists of a frame, a spinning handle, and a center;

wherein the frame connects to the outer surface of the top half; and wherein the center connects the frame to the spinning handle; and wherein the spinning handle can rotate about the center.

7. The fire hose holding apparatus as described in claim 1 wherein a second locking clasp is used at each end of the bottom half and the top half in order to secure the clamp about the fire hose.

8. The fire hose holding apparatus as described in claim 1 wherein the clamp is adapted for use with the fire hose of differing diameters.

* * * * *